US006530167B1

(12) United States Patent
Schuetz et al.

(10) Patent No.: US 6,530,167 B1
(45) Date of Patent: Mar. 11, 2003

(54) MOUNTING CHANNEL AND PRESENTATION MEANS FOR MOUNTING PRESENTATION ELEMENTS

(75) Inventors: Stephan Schuetz, Kleinfeldstrasse 26, 70734 Fellbach (DE); Gerhard Kueffner, Fellbach (DE)

(73) Assignee: Stephan Schuetz (DE)

( * ) Notice: Subject to any disclaimer, the term of this patent is extended or adjusted under 35 U.S.C. 154(b) by 0 days.

(21) Appl. No.: 09/663,895

(22) Filed: Sep. 18, 2000

(30) Foreign Application Priority Data

Sep. 18, 1999 (DE) ..... 199 44 856

(51) Int. Cl.[7] ..... G09F 7/02
(52) U.S. Cl. ..... 40/611; 40/618
(58) Field of Search ..... 40/611, 610, 618

(56) References Cited

U.S. PATENT DOCUMENTS 3,102,351 A * 9/1963 Howell ..... 40/611
5,355,603 A * 10/1994 Luikkonen ..... 40/541
5,448,844 A * 9/1995 Miller, Jr. et al. ..... 40/611
5,448,845 A * 9/1995 Gibson ..... 40/611

* cited by examiner

*Primary Examiner*—Cassandra H. Davis
(74) *Attorney, Agent, or Firm*—Akerman Senterfitt

(57) ABSTRACT

A mounting channel and presentation mechanism for mounting presentation elements. Both planar and curved presentation elements may be simultaneously mounted on the same supporting element. A mounting channel for mounting presentation elements has a curved outer contour, especially one resembling the shape of a segment of an ellipse. A U-section is additionally inscribed in the outer contour.

10 Claims, 5 Drawing Sheets

MOUNTING CHANNEL AND PRESENTATION MEANS FOR MOUNTING PRESENTATION ELEMENTS

FIELD OF APPLICATION AND PRIOR ART

The present invention relates to a mounting channel and presentation means for mounting presentation elements.

It is generally known in exhibition stand construction to use extruded mounting channels as supporting structural elements for planar or for curved structural components. It is general practice in exhibition stand construction to require that the structural components be self-supporting in order to allow easy transportation and assembly of the elements of which the exhibition stand is composed. On the other hand, sufficient stability of the elements must be guaranteed in order to prevent, for example, the exhibition stand from being damaged by the visitors of the exhibition and to guarantee the required degree of public safety.

At the same time, the presentation means should be both flexible and have, if possible, smooth enclosing elements to permit visually effective presentation. Fixing the presentation means on the building as such is not possible, or not desired, in most of the cases.

OBJECT OF THE INVENTION AND SOLUTION

It is the object of the present invention to permit both planar and curved presentation elements to be simultaneously mounted on the same supporting element.

Starting out from the generic mounting channels and presentation means, the invention achieves this object by the characterizing features of the independent claims.

A mounting channel for mounting presentation elements has a curved, especially convex outer contour resembling the shape of a segment of an ellipse. A U-section is additionally inscribed in that outer contour.

A presentation means according to the invention comprises at least a base and mounting channels projecting from the base. Curved presentation elements can be mounted between two mounting channels. In addition to the mounting means of the curved presentation elements independent presentation elements for planar structural components are also formed on the mounting channels.

Further advantageous embodiments of the invention will be apparent from the claims and also from the specification and the drawings, it being understood that the different features may be implemented in an embodiment of the invention or in other applications either each alone or as sub-combinations of several features and may as such constitute advantageous and independently patentable embodiments for which protection is claimed. The division of the specification into several sections and the sub-titles used herein are not meant to limit the generality of the statements contained thereunder.

DESCRIPTION OF THE EXEMPLARY EMBODIMENT

Figure 1:
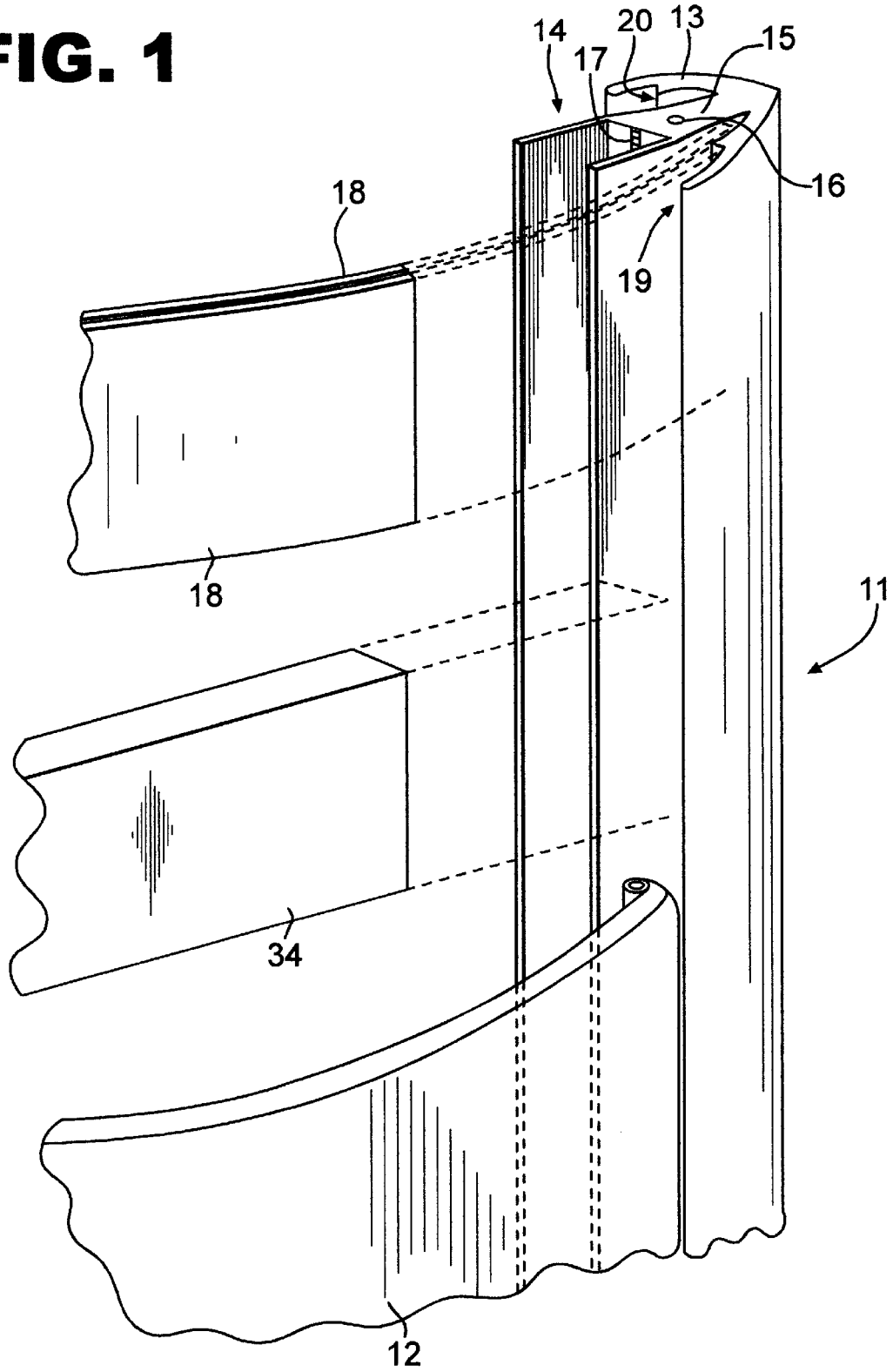
FIG. 1 shows a representation of the mounting channel according to the invention, with different presentation elements.

FIG. 1 shows a mounting channel according to the invention and a plurality of presentation elements 12, 18 that can be mounted on the mounting channel, as well as a cross-member 34 that can likewise be mounted on the mounting channel 11. In cross-section, the mounting channel 11, being preferably produced as an extruded section, has a convex elliptical outer contour 13. Inside the outer contour 13 there is formed a stiffening body 15, with the U-channel 14 projecting from the latter. The U-channel 14 and the outer contour 13, and/or the stiffening body 15 and the outer contour 13 form between them a slot-shaped receiving opening 19. The slot-shaped receiving opening preferably comprises a step 20 formed on the inside of the outer contour 13 and facing the stiffening body 15 and/or the U-channel 14. The outer contour preferably has an approximately elliptical shape. According to a preferred embodiment, the mounting channel 11 has a mirror-symmetrical configuration, relative to a central plane. The main axis of the elliptical outer contour extends along the central plane. The outer contour 13 is flattened in the vertex area of the ellipse. This flattened portion permits mounting channels to be connected one with the other "back to back".

Between the two legs of the U-channel 14, there is arranged an electric conductor 17 that can be connected to a current source and from which current can be tapped via electric contact points that can be provided on the presentation elements. This is of advantage in particular when electric consumers are incorporated in the presentation elements. Such electric consumers may include, especially, loudspeaker systems with amplifiers, illumination systems, such as backlighting systems, especially with luminescent lamps and spotlights, especially low-voltage spotlights. A plurality of presentation elements 12, 18, 34 can be mounted on the mounting channel 11. Curved presentation elements are inserted into the slot-shaped receiving opening between the stiffening body and/or the U-channel 14 and the inside of the outer contour 13. Preferably, the configuration of the receiving opening in lengthwise direction is such that the frictional contact suffices to secure the vertical position of the curved presentation element 18. Alternatively, or in addition to the above arrangement, elements intended to secure the position of curved presentation means 18 may be fastened on the U-channel 14. The curved presentation means 18 may include, especially, wooden panels, plexiglass panes, including such with a frosty appearance to achieve efficient diffusion of the light from a light source arranged behind the pane. sheet-metal plates such as perforated plates, or the like. Curved presentation means 18 are preferably configured to be flexible so that they can be inserted easily into the slot-shaped receiving opening 19 and are held in the mounting channel 11 by the tension resulting from the bending stress introduced for producing the curvature. Like planar presentation elements 12, the curved presentation means 18 may also be designed as information carriers, for example as sign boards or image carriers.

A particularly advantageous configuration is obtained when a step 20 is provided in the receiving opening 19. Preferably, the step is formed on the inside of the outer contour 13, facing the U-channel. The step permits two presentation elements 18, one arranged above the other, to be independently inserted into the receiving opening 19 and to be held therein—each in the respective plane of the step. So, there is, for example, the possibility to initially insert a light-diffusing frosty plexiglass pane. Later, a second curved presentation element carrying a motive, for example a transparency or another plexiglass pane provided with a text or an image, may then be placed above the first plexiglass pane, which serves as a diffuser for the backlighting. The guiding effect of the stepped receiving opening 19 ensures in this case a well-defined position of the two curved presentation elements one relative to the other.

The U-channel 14 formed on the mounting channel 11 serves for mounting non-curved presentation elements 12, 34. For example, the U-channel 14 is suited for mounting cross-members 34 or doors for display cases, storage positions or material supplies, which doors may for example consist of a frame with a filling or of a filling material. In the case of a door, such elements are mounted on the U-channel 14 of the mounting channel 11 with a stop, for example.

Figure 2:
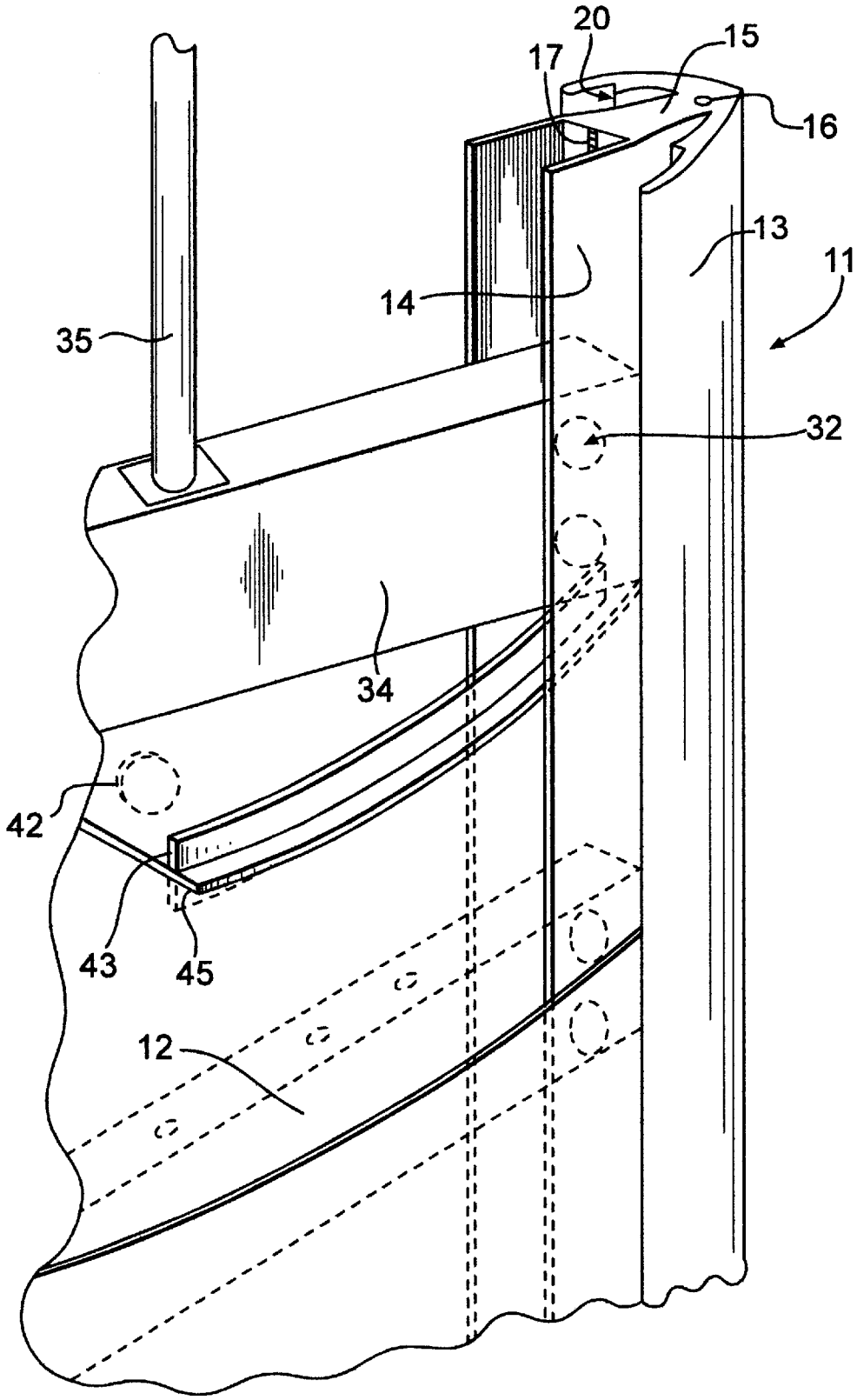
FIG. 2 shows a representation of the mounting channel according to the invention, with further presentation elements.

FIG. 2 likewise shows a mounting channel according to the invention, configured in the same way as the mounting channel illustrated in FIG. 1. It can be seen that one end of the cross-member 34 is mounted in the U-channel 14 by means of detachable or undetachable fastening means 32 that are passed through the U-channel 14 and that may for example consist of screws, rivets or bolts secured by retainer rings, while its other end, not shown in the drawing, is likewise mounted on a mounting channel 11. Contact with the electric consumer 35—in the present case a luminescent lamp—is established by contact elements via the cross-member 34, so that the consumer can be put into operation in this mounted condition. A cross-member 34 is provided with a bottom surface 44. A fitting edge 43 provided on the bottom surface 44 defines the curvature of a curved presentation element which covers the area of the cross-member 34, is held in the mounting channel 11 in the slot-shaped receiving opening 19 and which rests against the edge 45. In addition, the bottom surface 44 may be provided with lamp bores 42 serving to accommodate lamps or spotlights for illuminating the area of another presentation element 12, which is located below the before-mentioned bottom surface 44 and is likewise configured as a planar horizontally aligned element. The presentation element 12 may, for example, serve for presenting exhibits, as display surface for leaflets, or the like. For this purpose, the U-channel may either be provided with a matrix of bores from the very beginning, or the bores may be applied individually and may be flexibly adapted to the particular requirements of the case.

Figure 3:
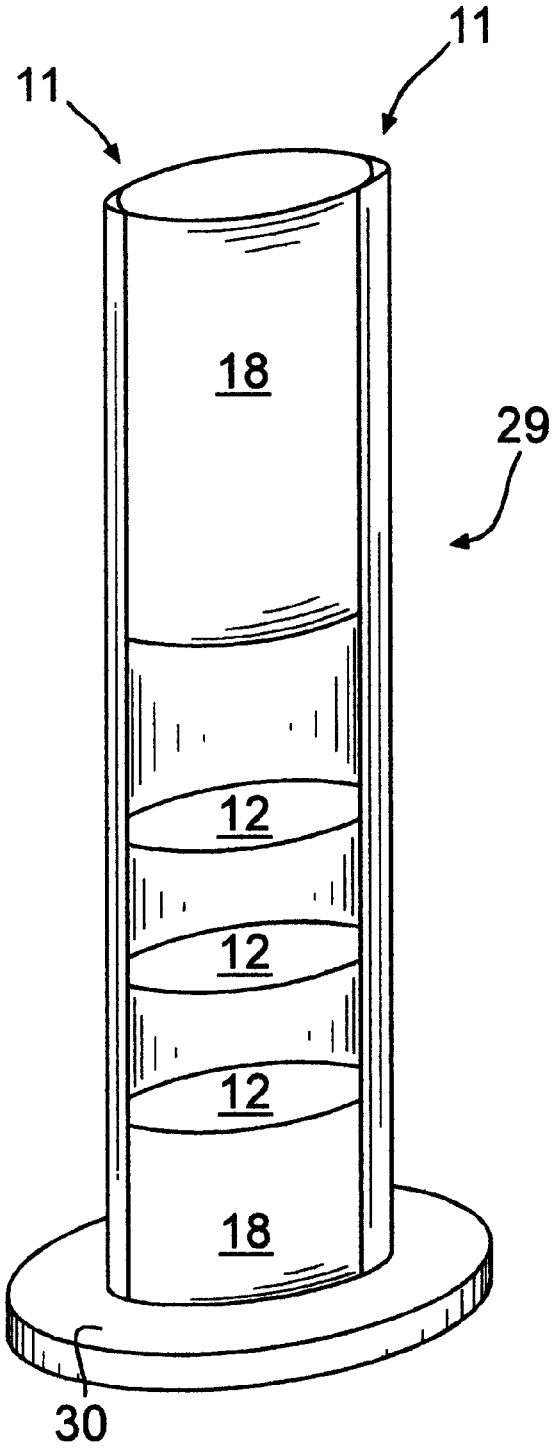
FIG. 3 shows a presentation means having a base and two mounting channels.

FIG. 3 shows a presentation means 29. The presentation means 29 consists of a base 30 with two mounting channels, as represented in FIGS. 1 and 2, projecting from the base in vertically upward direction. The open sides of the U-channels 14 of the mounting channels 11 face each other, as do the slot-shaped receiving openings 19. On the upper end of the two mounting channels, a curved presentation element 18 is arranged between the mounting channels. This may consist, for example, of two plexiglass panes, the lower plexiglass element—in the viewing direction—being a frosty plexiglass pane having a larger wall thickness than the upper plexiglass element, which latter is clear and transparent. Now, the upper plexiglass element, i.e. the outer element of the presentation means facing the observer, is directly used as information carrier. Alternatively, a film, for example a transparency or any other image, may be placed between the two plexiglass panes. If presentation elements are arranged on each mounting channel, on both sides of the U-channel 14, and/or in the slot-shaped receiving opening 19, then a closed body is obtained.

Another curved presentation element 18 is arranged at the lower end of the two mounting channels, in the area before they join the base 30, where the two mounting channels are fastened, for example, either detachably by screwing or undetachably by welding, The open portion extending therebetween is subdivided by three planar presentation elements 12 formed by shelves. There is also the possibility to provide behind the shelf a rear wall, consisting of a curved presentation element 18. Advantageously, the presentation elements 12 are detachably held in the mounting channel 11 by clamp-type connections. A clamp-type connection for mounting the presentation elements 12 provides the advantage that the position of the presentation element can be infinitely adjusted in the vertical direction of the mounting channel.

Figure 4:
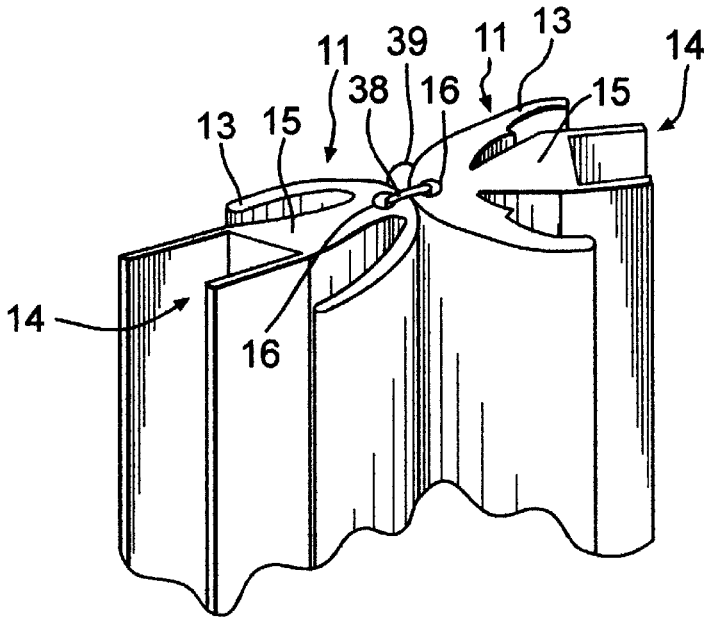
FIG. 4 shows a diagrammatic representation of the connection between the mounting channels.

FIG. 4 shows two mounting channels connected by a presentation means 38. The connection of the mounting channels is such that the open sides of the U-channels 14 of the mounting channels 11 face in opposite directions. A predetermined angular orientation between the two mounting channels can be achieved by the trimming plate 39, which on the one hand serves to cover the gap encountered between the two mounting channels 11 and on the other hand defines a fixed angle between the surfaces of the outer contour. Each of the mounting channels 11 has a substantially elliptical outer contour 13 that is flattened in the vertex area of the ellipse. The two mounting channels 11 are in contact one with the other in the area of that flattened portion. Both mounting channels comprise additionally the stiffening body 15, which latter is provided with a bore 16 passing through the mounting channels. The bore 16 serves on the one hand to permit tension elements, such as wire ropes or the like to be pulled through the mounting channel 11. Further the bore 16 may serve as cable duct. A connection means 38 serves for bracing the two mounting channels 11.

If the mounting channels are always connected in pairs in this way, and if presentation elements 12, 18 are arranged between the two oppositely oriented mounting channels, whose U-channels 14 face each other, then a longer, room-dividing element of variable configuration can be constructed.

Figure 5B:
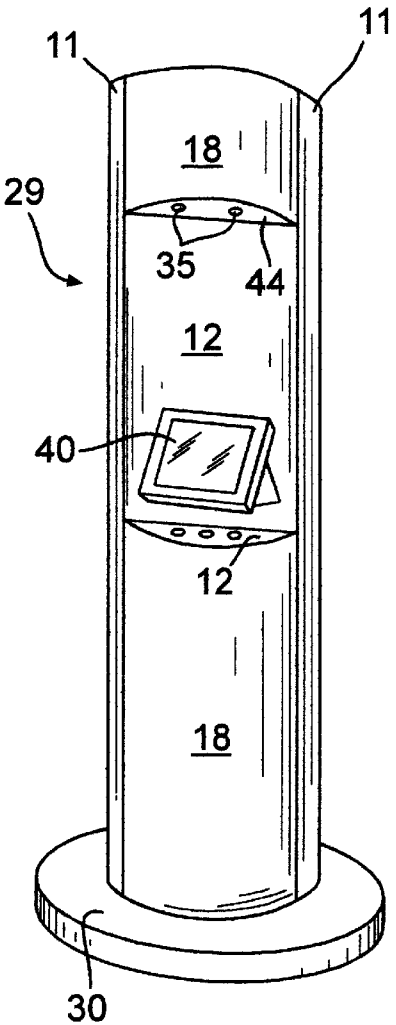
FIG. 5A, show different presentation elements in connection with presentation FIG. 5B means according to the invention.
Figure 5A:
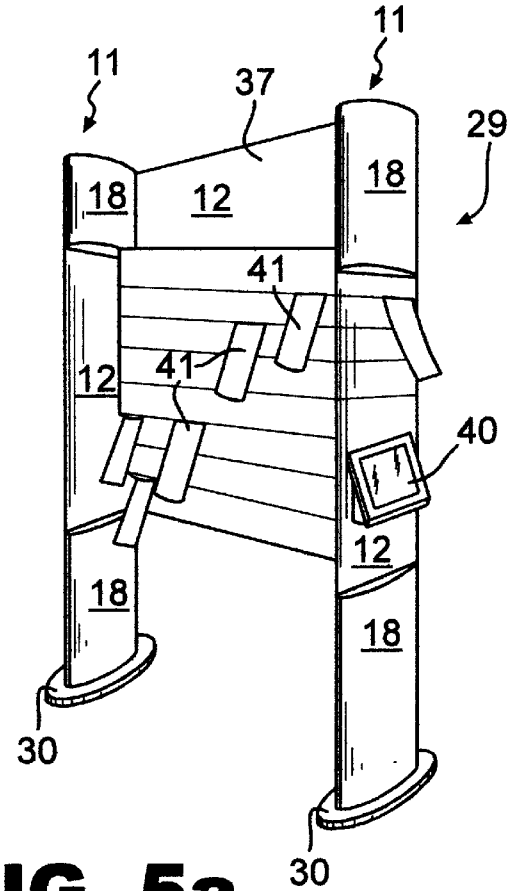

FIGS. 5A and 5B show further possible embodiments. In FIG. 5A, two presentation means 29 are provided, the structure of which corresponds to that described in FIGS. 1 to 4. Preferably, each presentation means 29 comprises at least two cross-members 34 arranged between the two mounting channels 11 of the presentation means. The cross-members 34 are, preferably, screwed or riveted together, via bores passing through the U-channel 14, in order to obtain a solid connection between the cross-member 34 and the mounting channel 11. Between the two presentation means 29, there is provided a structural element 37 which, preferably, has its two ends fixed to the cross-members 34. The structural element 37 may, for example, be a planar element made from wood, plexiglass or metal. It may serve as trimming plate or presentation element 12 and may be provided with markings or other elements mounted thereon, such as leaflet holders 41. The structural element 37 is an element which, while being self-supporting, is not suited as a free-standing unit. A display screen 40 is arranged on one of the two presentation means 29, in the area of a presentation element 12. The display 40 may be held between the mounting channels 11 of the presentation means 29, for example by a clamp-type holder fixed in the U-channel 14.

FIG. 5B shows a further embodiment of a presentation means 29. In this case, two curved presentation elements 18 are arranged at the top and at the bottom respectively, between the two mounting channels 11 projecting vertically from the base 30. Between the two elements, there is provided a flat presentation element 12, serving as rear wall and extending evenly in the U-channel of the two mounting channels 11. There is further provided a flat, horizontally extending presentation element 12, being preferably mounted on a cross-member 34 and extending beyond the outer contour of the curved presentation element 18 at the front. The presentation element 12 carries a display 14. The cables supplying the display may, preferably, be run through bores into the space covered by the curved presentation element 18, The bottom surface 44 that closes off the upper curved presentation element 18 at its bottom, contains two spotlights 35, that are preferably directed upon the planar presentation element 12.

Figure 6:
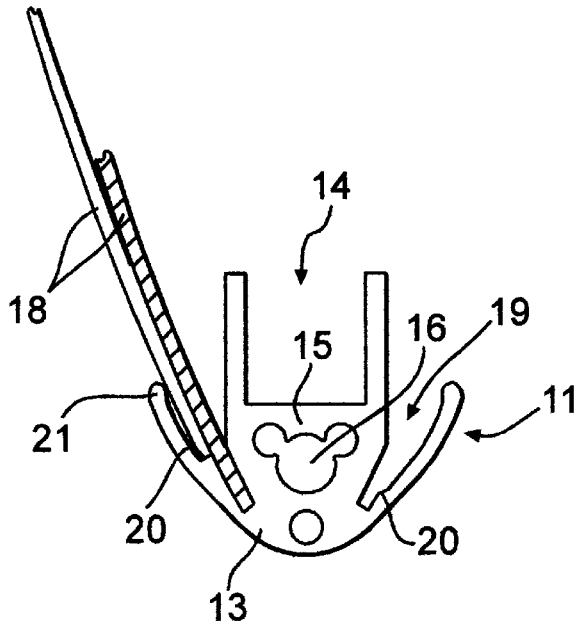
FIG. 6 shows a cross-section through a mounting channel and two plexiglass panes arranged in it, that serve as curved presentation elements.

FIG. 6 shows once again a cross-section through a mounting channel according to the invention and two plexiglass panes arranged therein, that serve as presentation elements. The mounting channel 11 has the substantially elliptical outer contour 13, flattened in the area of its vertex. Inside the outer contour 13, the stiffening body 15 is formed, with a U-channel 14 formed thereon. Between the U-channel 14 and the stiffening body 15 and/or the outer contour 13 one can see the slot-shaped receiving opening 19 provided with a step 20. Two plexiglass panes 18 are inserted into that slot-shaped receiving opening 19, as curved presentation elements. The rear presentation element, resting against the stiffening body 15, is a plexiglass pane of larger cross-section, which is clamped, and is thereby held at is a defined angle, in the deeper portion of the receiving opening formed by the step 20. The other front plexiglass pane 18 does not project the same length into the mounting channel 11. It is thinner than the rear plexiglass pane. A contact point 21 formed at the forward projecting end of the outer contour 13 serves to urge the front plexiglass pane against the rear plexiglass pane. The front pane rests on the rear pane in floating condition. A transparent film, such as a transparency, text or the like, may be placed between the two panes. It is thereby guaranteed that the two plexiglass panes rest properly one against the other, guided in a groove, whereby a precise oval or circular shape is achieved. At the same time, this stepped design results in a high degree of stiffness of the overall structure, although the presentation elements 18 in the form of plexiglass panes, instead of being firmly connected with the mounting channels 11, are only clamped therein. Nevertheless, this arrangement permits a precise and defined shape to be achieved for a curved presentation element 18 arranged between two mounting channels 11 of a presentation means as represented in FIGS. 3 to 5B.

What is claimed is:

1. A mounting channel for mounting presentation elements, the mounting channel heaving a curved outer contour, wherein:

a U-channel is inscribed in the outer contour;

a slot-shaped receiving opening for curved presentation elements is formed between the outer contour and at least one of the U-channels and a stiffening body; and at least one electric conductor is provided in the U-channel.

2. The mounting channel as defined in claim 1, wherein the stiffening body is formed between the outer contour and the U-channel.

3. The mounting channel as defined in claim 1, wherein a slot-shaped receiving opening comprises a step on an inside of the outer contour facing the U-channel.

4. A presentation means having at least one base and of mounting channels projecting from the base, such that curved presentation elements can be fixed on holding means between two mounting channels, wherein:

the mounting channels comprise presentation elements for at least one of planar structural elements and presentation elements, independent of the holding means for the curved presentation elements;

the planar structural elements are cross-members arranged between the mounting channels; and each mounting channel comprises an electric conductor, a circuit between the two electric conductors being closed by electric consumers arranged on cross-members.

5. The presentation means as defined in claim 4, wherein the mounting channels consist of a U-channel with presentation means passed therethrough.

6. The presentation means as defined in claim 4, wherein the structural elements are fixed in a U-channel by frictionally engaged mounting means.

7. The presentation means as defined in claim 4, wherein the holding means are configured as a slot-shaed receiving opening in the mounting channel.

8. The presentation means as defined in claim 4, wherein at least two presentation means serve as a holder for at least one structural element held between presentation means.

9. The presentation means as defined in claim 4, wherein mounting channels of neighbouring presentation means be connected one with the other by connection means.

10. The presentation means having at least one base and mounting channels projecting from the base, such that curved presentation elements can be fixed on holding means between two mounting channels, wherein:

The mounting channels comprise presentation element for at least one of planar structural elements and presentation elements, independent of the holding means for the curved presentation elements; and mounting channels of neighbouring presentation means can be connected one with the other by connection means.

* * * * *